United States Patent [19]

Julian

[11] Patent Number: 4,848,694

[45] Date of Patent: Jul. 18, 1989

[54] STRIP DECOILER

[76] Inventor: Joseph Julian, 111 Buena Vista Dr., Plantsville, Conn. 06479

[21] Appl. No.: 219,256

[22] Filed: Jul. 15, 1988

[51] Int. Cl.[4] ..... B65H 23/185; B65H 59/38

[52] U.S. Cl. ..... 242/78.6; 242/128

[58] Field of Search ..... 242/45, 78.6, 128, 55, 242/75, 75.51, 105; 226/191, 19, 17, 16, 18, 20, 21, 22, 23

[56] References Cited

U.S. PATENT DOCUMENTS

| | | | |
|---|---|---|---|
| 1,677,167 | 7/1928 | Borgeson | 242/128 |
| 2,772,840 | 12/1956 | Goodhue et al. | 242/128 |
| 2,903,635 | 9/1959 | Brook et al. | 242/45 |
| 3,495,784 | 2/1970 | Bradlee | 242/75.5 |
| 3,933,322 | 1/1976 | Satzinger | 242/78.6 X |
| 3,995,758 | 12/1976 | Kovaleski | 242/128 X |
| 4,249,705 | 2/1981 | Brooks et al. | 242/78.6 |
| 4,582,271 | 4/1986 | Takahashi | 242/78.6 X |

FOREIGN PATENT DOCUMENTS

| | | | |
|---|---|---|---|
| 1293537 | 10/1972 | United Kingdom | 242/128 |

*Primary Examiner*—David Werner
*Assistant Examiner*—John M. Eghtessad
*Attorney, Agent, or Firm*—Dallett Hoopes

[57] ABSTRACT

The strip decoiler of the invention has a dancer arm in a vertical plane which sets the speed of the decoiler turntable. The lower end of the dancer arm mounts an adjustable connection which in turn supports a spool shaft carrying a support spool. The spool shaft can be swiveled about so that the spool can support the decoiling strip evenly all across its width. The shaft is quickly and easily adjustable for use with clockwise or counterclockwise uncoiling.

8 Claims, 2 Drawing Sheets

STRIP DECOILER

BACKGROUND OF THE INVENTION

1. Field of the Invention

This invention relates to a strip decoiler which automatically sets the speed of decoiling so that it smoothly decoils strip material. The decoiler of the invention also carefully transports the strip toward the end use without local stress which might otherwise deform the strip and spoil it.

The decoiler of the invention also has means rapidly and easily to convert the decoiling operation from a clockwise to a counterclockwise take-off, or vice versa, depending on the direction of the coil winding, and still provides a smooth decoiling and transporting operation.

2. Description of the Related Art Including Information Disclosed Under §§1.97–1.99

The prior art includes many decoiling apparatuses. Decoilers generally of the same type, including a horizontal-driven platform and a take-off arm which controls the speed of the platform, are disclosed in U.S. Pat. No. 3,476,330, which issued Nov. 4, 1969 to Curtland; U.S. Pat. Nos. 4,304,370, which issued Dec. 8, 1981, and 4,610,408, which issued Sept. 9, 1986, both to William A. Box et al.; and U.S. Pat. No. 4,582,271, which issued Apr. 15, 1986 to Takahashi.

Illustratively the Box U.S. Pat. No. 4,304,370 discloses a powered platform adapted to support stacked coils of strip stock and a guide frame adapted to move toward and away from the periphery of the coil. The strip loops from the coil around the guide frame on the way to the press or other end use. The guide frame is moveable and linked to a rheostat which controls the speed of the driven turntable. The guide frame is biased away from the coil. When the strip coming off the coil slackens, the guided frame moves away from the coil and slows the turntable. When the strip tightens around the guide frame and draws the guide frame closer to the coil, this speeds up the turntable.

Less pertinent, Takahashi, listed above, provides in a first embodiment a powered turntable, with an upright mast extending upward to the side of the turntable, a sleeve extending over the turntable at the top of the mast and a swinging arm at the outer end of the sleeve, the arm having a hook on the end adapted to hang down and to support the offcoming coil. The arm is biased away from the center of the coil and its upper end is mounted on a shaft extending through the sleeve and connected to a variable resistor which sets the speed of the turntable motor. The arm of Takahashi is described as being a "detecting member" or "guide rod" which is supported for movement above and "in a general radial direction from the center of the wound work material toward the outer periphery thereof." The Takahashi arm, in other words, is primarily for detecting the presence of slack in the moving strip and for moving outward from the center of the spool out toward the periphery when it detects such slack to, through the variable resistor, slow down the rotation of the turntable. There is no effort in Takahashi to support the strip in a way that will obviate local stress.

SUMMARY OF THE INVENTION

The present invention relates to means for not only decoiling coiled stock, but also for carefully transporting it to its end use by supporting it evenly without local stresses. Local stresses are to be avoided because they can actually stretch or otherwise deform the offcoming strip material and spoil it for its use. Under the present invention means for transporting the coiled stock, which also controls the speed of the decoiling turntable, comprises a supporting spool which is disposed at an appropriate angle with respect to the offcoming stock, and an essential provision of the invention is the ability to change this angle so that the apparatus may be quickly adjusted to move to a clockwise from a counterclockwise take-off and vice versa.

It is an essential of the present invention that the spool be located outside the periphery of the supply coil undergoing decoiling. The location of the spool has to be outside the periphery of the coil in order for the present decoiler to operate properly.

BRIEF DESCRIPTION OF THE DRAWINGS

Other objects and features of the invention will be apparent from the following specification and the drawings, all of which disclose a nonlimiting embodiment of the invention. In the drawings.

DESCRIPTION OF THE PREFERRED EMBODIMENT

Figure 3:
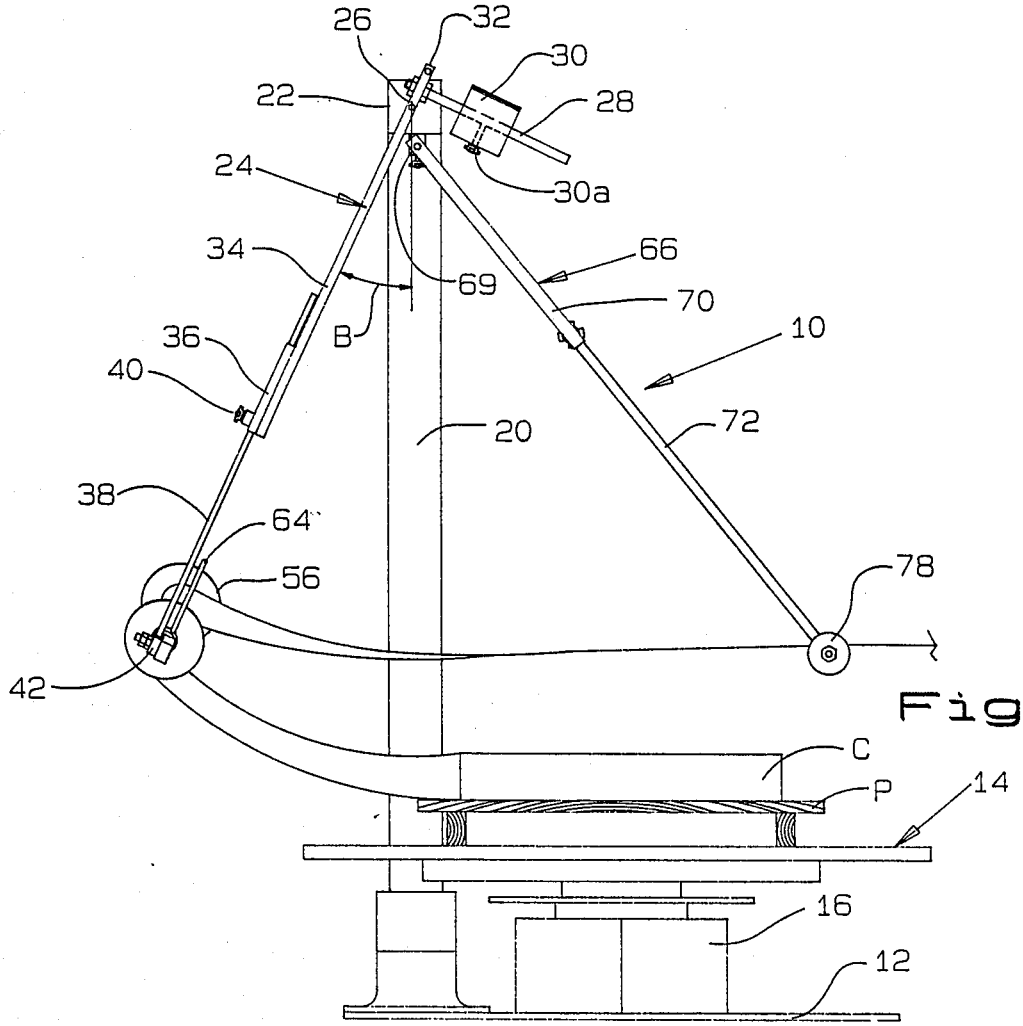
FIG. 3 is an enlarged front plan view of an apparatus uncoiling stock.
Figure 4:
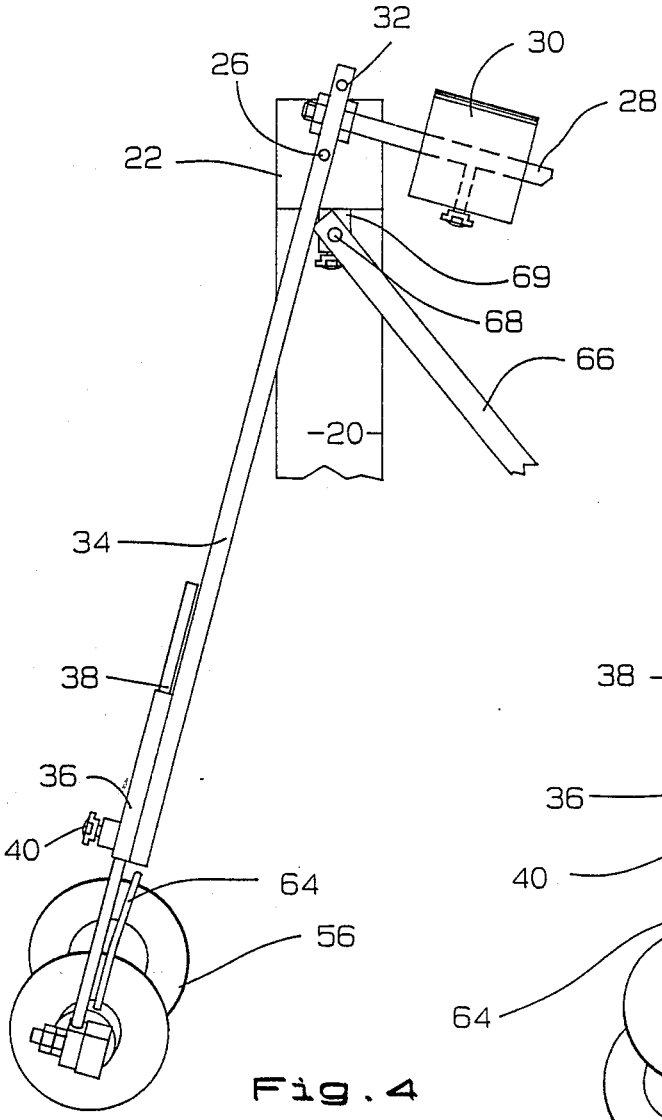
FIG. 4 is an enlarged fragmentary front end view with the spool shaft set to uncoil from a counterclockwise supply.

An apparatus embodying the invention is shown in FIG. 3, and generally designated 10. It comprises a base member 12 having a power-driven turntable 14 mounted thereon. The turntable is provided with power means 16 electrically driven.

Figure 1:
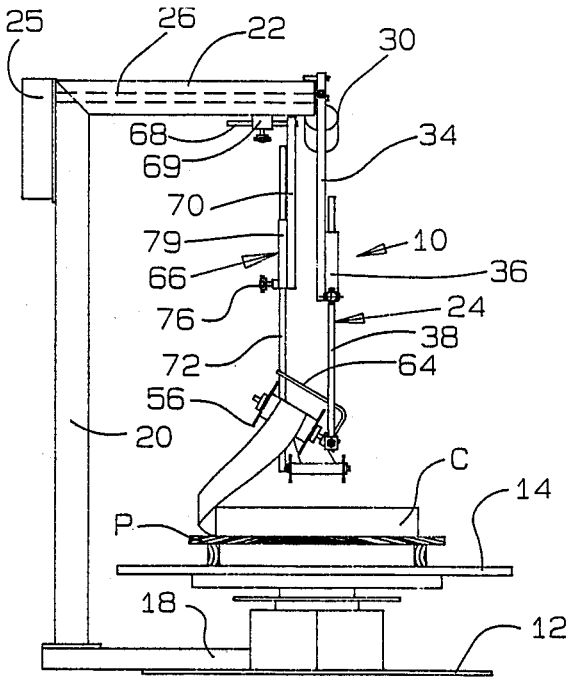
FIG. 1 is a side view showing a decoiler embodying the invention, decoiling stock from a counterclockwise supply.
Figure 2:
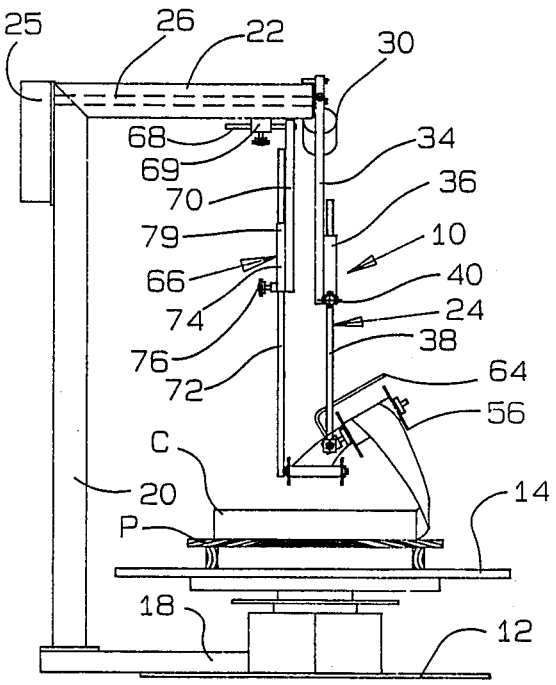
FIG. 2 is similar to FIG. 1 but showing the decoiler of the invention operating from a clockwise supply.
Figure 8:
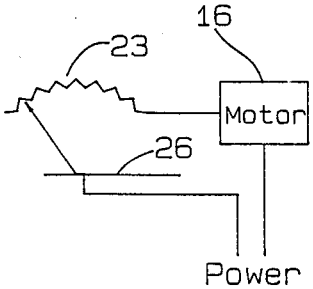
FIG. 8 is a circuit diagram of the electric circuit of the embodiment shown.

Projecting upward from an extension 18 of the base member 12 is a vertical mast 20. At the upper end of the mast 20 is a horizontal boom 22, which extends out from the mast and generally above the turntable 14, but specifically directly over an area outward of the periphery of the coil C (FIG. 3). A dancer arm 24 having an angle B, with the vertical swings in a vertical plane and has a horizontal shaft 26 (FIG. 1) adjacent its upper end, which is journaled in the end of the boom 22 and extends into the boom. The shaft is linked to a variable resistor 23 (FIG. 8) in control box 25. Above the shaft 26 the dancer arm 24 is provided with a perpendicular weight arm 28 carrying a weight 30, which may be fixedly adjusted therealong by a palm screw 30*a*. The extreme upper end of the dancer arm 24 is formed with an inward finger 32, which serves as a stop engaging against the top of the boom 22 to limit the outward swing of the dancer arm with respect to the coil supply.

The dancer arm 24 is in two sections. An upper section 34 has mounted against its lower end a sleeve 36. A lower section 38 is of lesser dimension than the upper section 34 and is adjustably slideable in the sleeve 36, its position being fixable by the palm screw 40.

Figure 6:
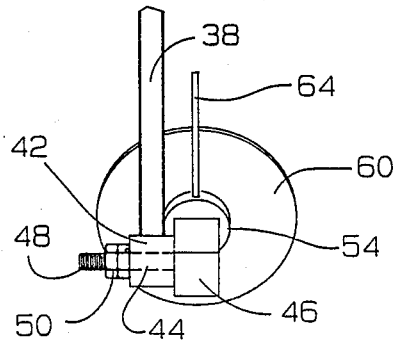
FIG. 6 is a further enlarged fragmentary view showing the adjustment elements for the spool shaft from the front.

The extreme lower end of the arm 24 mounts a block 42. The block 42 has a central opening 44. A second adjustment block 46 is formed with a fixedly mounted threaded stud 48 (FIG. 6) extending leftwardly through the opening 44. Jam nuts 50 are fixed to tightly draw the adjustment block 46 against block 42 so that the rotary position of block 46 may be stiffly adjusted by hand.

Figure 5:
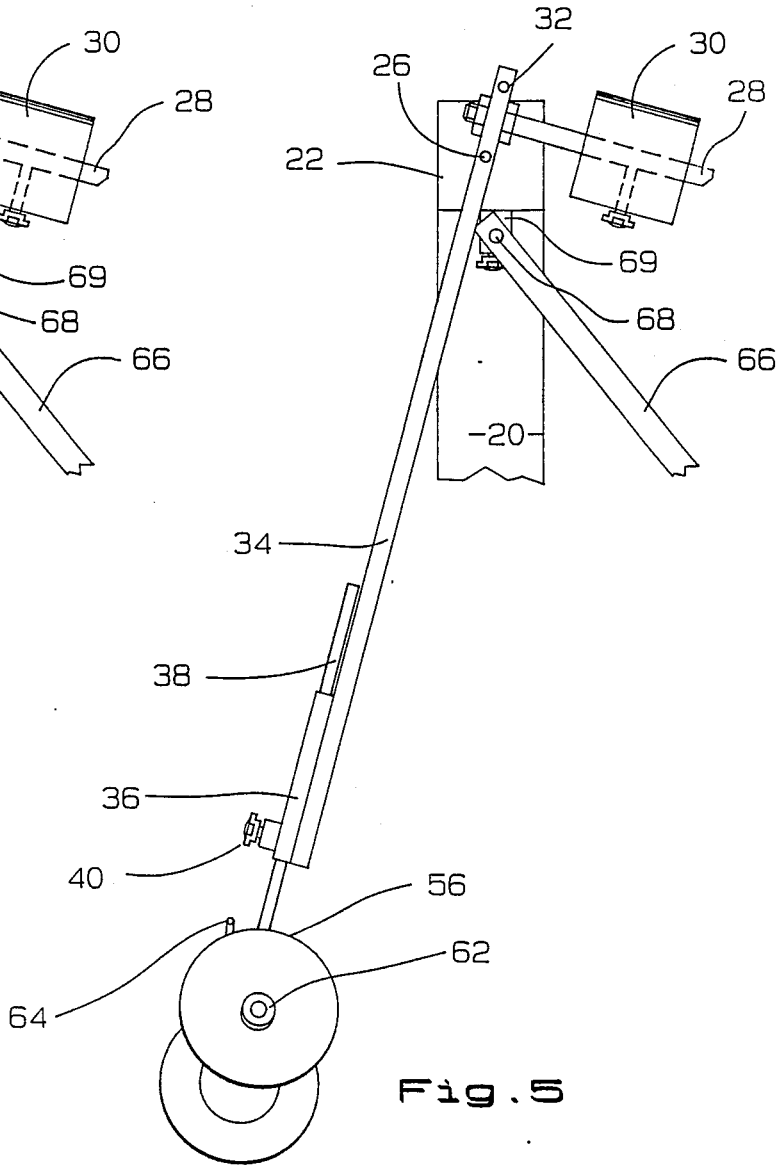
FIG. 5 is a view similar to FIG. 4 but showing the spool shaft set to uncoil from a clockwise supply.
Figure 7:
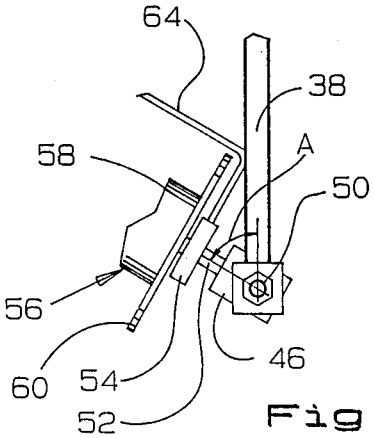
FIG. 7 is a left side view of the structure shown in FIG. 6.

Block 46 (FIG. 7) is formed with an upward spool shaft 52. It mounts a bearing collar 54 against which rests a spool 56 comprising a central drum 58 having an annular flange 60 on either end. An end cap 62 (FIG. 5) holds the spool on the spool shaft 52. A wire retainer 64 (FIG. 7) having a run parallel to and overlying the drum 58 completes the assembly. Retainer 64 serves to confine the strip between the flanges 56 and the drum 58.

A strip support arm 66 has at its upper end a short shaft 68, which is held in a clamp 69 fixed to the underside of the boom 22 so that the angle of the support arm 66 with respect to the mast 20 (FIG. 3) may be set. The support arm 66 is, like arm 24, comprised of an upper and lower section 70, 72. The upper section 70 carries a sleeve 74 thereagainst and receives the upper end of the lower part 72. A palm screw 76 fixes the relative position of the two parts of the support arm 66 and hence the length of the arm 66.

The lower end of the support arm 66 carries a horizontal support roller 78 mounted on a shaft perpendicularly fixed to the lower end of the arm 66. Preferably the arm 66 is set to support the spool 78 about half way between the decoiler and the press or other strip-using machine.

In operation (FIG. 1), with the coil C on pallet P on the turntable 14, the spool shaft 52 is disposed outward of the periphery of the coil C and is angled upward on the same side of the dancer arm from the place on the coil C at which the strip leaves the coil. The weight 30 biases the dancer arm away from the coil. The strip is then laid over the spool 56 under wire retainer 64 as shown and the support arm is set to be roughly with its roller 78 at the same level as the input throat of the press or other machine the supply serves. The coil is laid on the support spool and threaded into the press. Finally, the angle A of the spool shaft 52 with the dancer arm 24 of the spool shaft 52 is adjusted by hand so that the strip contacts the spool across its full width. In this relation it is assured that the strip is not supported on the spool only by an edge of the stock, for this would bend, stretch or otherwise locally deform the strip.

As the decoiling proceeds, slack in the strip is detected as the weight 30 moves the dancer arm 24 out. Proportionately the variable resistor slows down the turntable to let the press take up the slack. Conversely when the arm 24 detects the tightening of the strip as the press uses more, the arm 24 moves slightly closer to the periphery of the coil and the resistor 23 (FIG. 8), turned by the shaft 26, speeds up the turntable.

All during this time the coil is evenly supported on the spool, entirely across the width of the strip and is spared the local deformation which would otherwise occur.

If a subsequent coil supply is from an opposite sense—i.e., counterclockwise rather than clockwise or vice versa—the spool shaft is turned by hand to the other side of the dancer arm and the above process of setting up is repeated. This adjustment of the dancer arm is performable without tools, simply with hand pressure. It may be made quickly and without fuss.

As a result of the present invention the strip stock is carefully decoiled and transported as described and arrives at the press or the like undeformed.

Variations of the apparatus are possible. Hence, while the invention has been disclosed in a preferred embodiment, the invention is not so limited but is susceptible of many changes and variations, all within the scope of the invention. The invention is defined by following claim language and equivalents thereof.

What is claimed is:

1. A strip decoiler comprising:

a. a turntable having a base and adapted to support a coil of strip disposed on its side;

b. driving means for rotating the turntable;

c. a vertical mast extending up from the base adjacent one side of the turntable, the mast having at its upper end a horizontal boom extending out over the turntable, the boom having a proximate end attached to the mast and a distant end, a horizontal shaft bearing mounted in the distal end of the boom;

d. a dancer arm disposed in a vertical plane and having a fixed perpendicular shaft journaled in the shaft bearing and adapted to swing with its lower end moving along a line extending generally radially outward beyond the periphery of the coil, the arm being biased away beyond the periphery of the coil;

e. a spool shaft;

f. a spool rotatably mounted on the spool shaft, the spool having a central drum portion and end flanges on either end of the drum portion;

g. a pair of relatively rotatable radial adjustment elements held in radially adjustable relation by fastener means, one of the elements being mounted on the distal end of the dancer arm, the other being mounted on an end of the spool shaft;

h. variable electrical resistive means associated with the shaft of the dancer arm and connected with the driving means to relate the speed of the turntable to the angle of the dancer arm relative to the vertical, whereby the angle of the spool relative to the dancer arm may be adjusted so that the strip coming from the coil rides flat against the drum portion across the full width of the strip.

2. A strip decoiler as claimed in claim 1 wherein the dancer arm is biased by a weight adjustably attached to a weight arm, extending rigidly out from the dancer arm in the same vertical plane as the dancer arm.

3. A strip decoiler as claimed in claim 1 wherein means are provided to adjust the length of the dancer arm.

4. A strip decoiler as claimed in claim 1 wherein a support arm is adjustably pivoted to the boom and its distal end is provided with a strip-support roller.

5. A strip decoiler as claimed in claim 1 wherein the fastener means is a threaded fastener.

6. A strip decoiler as claimed in claim 5 wherein the radially adjustable elements are a pair of blocks held compressively together by the threaded fastener.

7. A strip decoiler as claimed in claim 5 wherein the threaded means hold the adjustment elements in stiffly manually adjustable relation.

8. A strip decoiler as claimed in claim 1 wherein a strip retainer wire is mounted on the spool shaft and extends out over the spool and is spaced therefrom and has a section parallel to the spool shaft.

* * * * *